United States Patent [19]

Albertson

[11] 4,018,264

[45] Apr. 19, 1977

[54] BOILING HEAT TRANSFER SURFACE AND METHOD

[75] Inventor: Clarence E. Albertson, Villa Park, Ill.

[73] Assignee: Borg-Warner Corporation, Chicago, Ill.

[22] Filed: Apr. 28, 1975

[21] Appl. No.: 572,376

[52] U.S. Cl. ..... 165/1; 165/133

[51] Int. Cl.[2] ..... F28F 13/18

[58] Field of Search ..... 165/133, DIG. 14, 105, 165/1; 29/157.3 R, 157.3 A, 157.3 AA, 157.3 B

[56] References Cited

UNITED STATES PATENTS

| | | | |
|---|---|---|---|
| 3,696,861 | 10/1972 | Webb | 165/133 |
| 3,706,127 | 12/1972 | Oktay et al. | 165/DIG. 14 |
| 3,768,290 | 10/1973 | Zatell | 165/133 |
| 3,906,604 | 9/1975 | Kakizaki et al. | 165/133 |

OTHER PUBLICATIONS

IBM Tech. Discl. Bulletin, vol. 14, No. 9, Feb., 1972, Ingram et al.

IBM Tech. Discl. Bulletin, vol. 14, No. 9, Feb., 1972, Bakelaar et al.

*Primary Examiner*—Carlton R. Croyle
*Assistant Examiner*—L. J. Casaregola
*Attorney, Agent, or Firm*—Thomas B. Hunter

[57] ABSTRACT

Nucleate boiling or ebullition in pool boiling applications is improved by the use of a heat transfer surface having dendrites or nodules electroplated onto the substrate. The nodules are formed by plating at high current densities, and may be further electroplated at lower current densities to strengthen and enlarge them. Also described are deforming techniques, such as cold-rolling, to flatten the ends of the nodules and strengthen them by work hardening.

2 Claims, 1 Drawing Figure

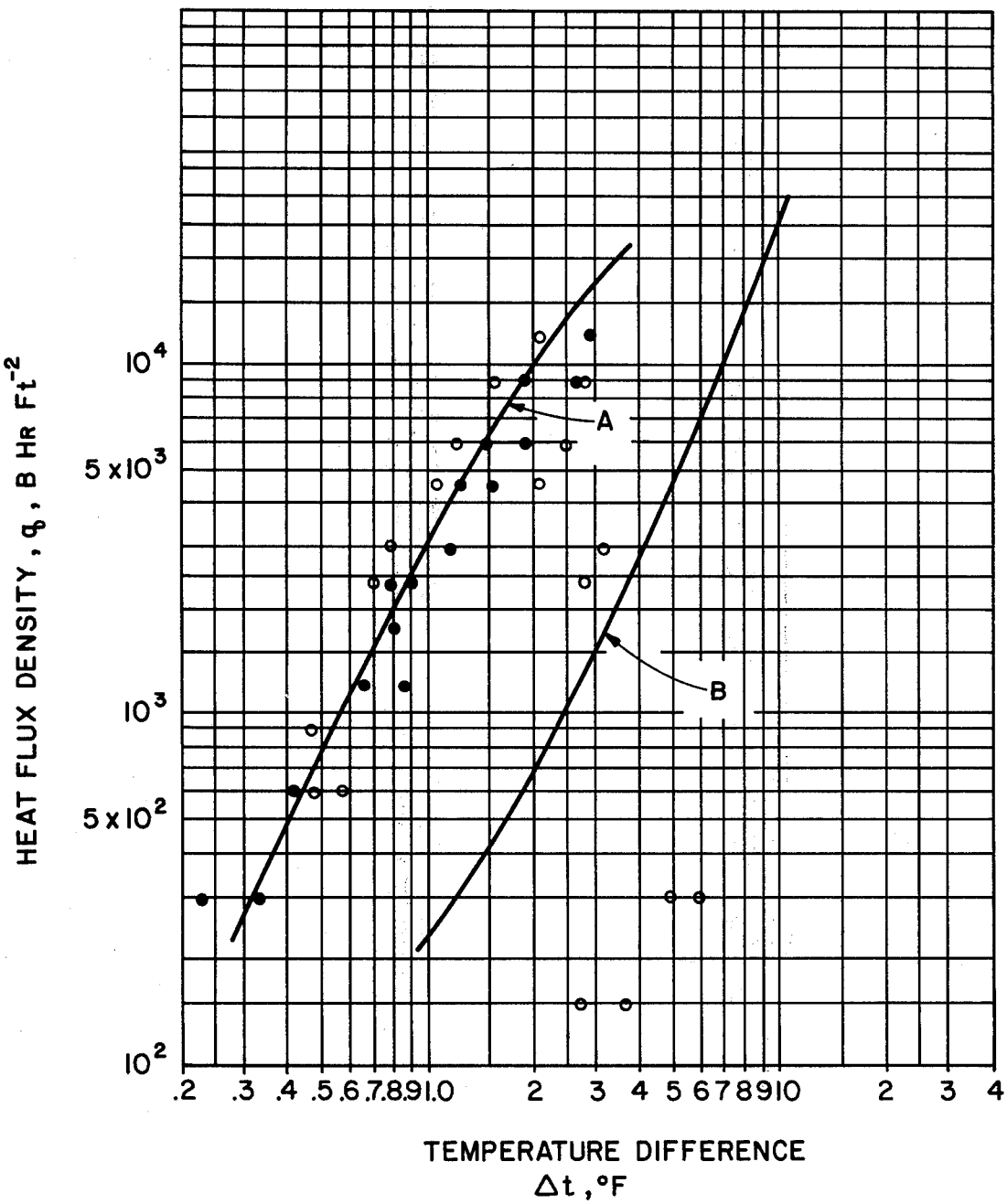
HEAT FLUX DENSITY, $q_b$, B HR Ft$^{-2}$
$10^4$
$5 \times 10^3$
$10^3$
$5 \times 10^2$
$10^2$
A
B
.2 .3 .4 .5 .6 .7 .8 .9 1.0 2 3 4 5 6 7 8 9 10 2 3 4
TEMPERATURE DIFFERENCE
$\Delta t$, °F

BOILING HEAT TRANSFER SURFACE AND METHOD

BACKGROUND OF THE INVENTION

1. Field of the Invention

Nucleate boiling enhancement, especially in flooded chillers using a halocarbon refrigerant.

2. Description of the Prior Art

U.S. Pat. No. 3,384,154 (Milton) contains a lengthy description of the theory of nucleate boiling on porous surfaces. This patent is more particularly directed to sintered metal coatings on metallic substrates.

U.S. Pat. No. 3,293,109 (Luce et al) describes a method for producing a nodularized surface on a copper foil to improve the bonding characteristics in a laminar structure or for enamel coated wire. The copper body is first electroplated using relatively high current densities to produce the desired nodularized surface and then subsequently electrodepositing additional copper at lower current densities to produce a coating on the nodules.

U.S. Pat. No. 3,701,698 (Forestek), U.S. Pat. No. 3,518,168 (Byler et al), and U.S. Pat. No. 3,699,018 (Carlson) all describe techniques for producing roughened surfaces, similar to Luce et al, on copper bodies for improving bonding characteristics.

SUMMARY OF THE INVENTION

This invention relates primarily to improvements in nucleate boiling surfaces to enhance the pool boiling efficiency of heat exchange apparatus in which the boiling liquid, preferably a halocarbon refrigerant, is in contact with the treated surface. One of the better performing surfaces heretofore known is described in the Milton patent referred to above. One of the disadvantages of the Milton process is that the coating applied to the surface is sintered in place to provide a highly porous metallic coating on the substrate. This, of course, requires that the tube or other heat exchange body be placed in a furnace and heated to sintering temperatures, approximately 1760° F. Unfortunately, this heating process had a detrimental effect on the tube strength, and in the case of thin wall tubes requires special handling techniques, and in some cases, work hardening to build back the strength of the tube.

The surfaces which are proved by the present invention are deposited by known techniques and therefore the invention resides in recognizing that it is possible to improve boiling characteristics by providing a dendritic or nodularized surface onto the boiling surface substrate.

DESCRIPTION OF THE DRAWING

The single FIGURE is a graph comparing the heat transfer efficiency of a heat exchange tube of the present invention with a standard finned tube.

DESCRIPTION OF THE PREFERRED EMBODIMENTS

In order to best understand the principles of the present invention, the following examples are provided for illustrative purposes only.

EXAMPLE I

A ¾ inch copper tube having a wall thickness of about 3/16 inch was sanded, cleaned by etching 15 seconds in 50% $HNO_3$ at RT, rinsed, and then immersed in a sulfuric acid solution of a proprietary copper plating composition known as Cubath No. 2 manufactured by Sel-Rex Co. This composition is believed to contain a copper salt, such as copper sulfate and additives such as stabilizers and brighteners. The tube was electrically connected to a source of direct current such that it functioned as the cathode; and an annular, consumable copper anode was placed around the tube so that it was uniformly spaced from the surface of the tube. A current density of 1000 amps per sq. ft. was applied for about 20 seconds with gentle solution agitation. The current density was then reduced to about 50 amps per sq. ft. and plating continued for 1½ to 2 hours to coat the nodules with a strong, dense layer of copper.

Following the electrodeposition of the final layer of copper, the boiling heat transfer was further enhanced by rolling the tube between three rolls of a sheet metal bending machine to partially compact the nodules to closer proximity to one another and to strengthen them by work hardening and mechanical interlocking.

The tube was tested in a heat transfer test cell with refrigerant R-12 at about 37 psig. The FIGURE represents a plot of heat flux density (BTU/hr-ft$^2$) vs. the temperature differential between the refrigerant and the tube wall. The nodularized tube represented by plot A was clearly superior to the heat transfer efficiency of a standard finned tube (¾ inch O.D. — 26 fins/linear inch). The latter is shown in plot B on the FIGURE. Some temperature differential hyteresis was observed in generating the data shown in plot A, so the curve represents an average of the temperature differential values as the heat flux density was increased and then decreased.

EXAMPLE II

Instead of the concentric anode described in Example I, the tubes may be rotated while adjacent one or more flat plate anodes of a more standard (and economical) design.

A ¾ inch (O.D.) copper tube with an overall length of about 8 inches was mounted on a device which slowly rotated it in the bath while being plated. Electrical contact was made to the tube by a copper plate bolted to one leg of a Teflon support structure.

This copper plate had a cylindrical center section which extended half way through the leg of the mount. This section butted the copper tube which rotated against it continuously making electrical contact. The sample was rotated at about 11 RPM by a low speed motor bolted to the top of the Teflon mount. An O-ring transferred power between pulley wheels. The lower wheel was attached to a Teflon axle the other end of which was shaped to fit snugly into the copper tube. A pin could be put through a small hole in the end of the copper tube and into the Teflon to insure that no slippage occurred. Electrical contact at the other end of the tube was insured by a spring.

Two 5 inches × 11 inches phosphorized copper anodes ¼ inch thick were placed in the electrolyte and arranged vertically, spaced about 4½ inches apart. A Clinton Plater (Model 109CP) with a power supply capable of 0 to 100 amps and 0 to 15 v was used. A simple acid copper plating bath was used, containing 52.2 gms./l. sulfuric acid and 210 gms/l. $CuSO_4 \cdot 5H_2O$. Plating was initiated by supplying 100 amps (about 750 amps/ft$^2$) for one minute. Power was then reduced to a level of 5 amps (about 38 amps/ft$^2$) and plating continued for 1 hour. The plated tube showed good dendrite formation, especially near the ends of the tubes.

EXAMPLE III

The anodes were then moved closer to the tubes and placed at an angle of about 60° from the base of the plating tank such that they extended upwardly and outwardly away from the tube as in a "V". Copper tubes, as described in Example II, were plated with the anodes in this position and located approximately 1 inch from the tube. This allowed more uniform plating during both the high and low current density stages. The tube was plated under the same conditions as Example II. The sample had good nodule development all over with only slightly greater development on the ends relative to the center.

EXAMPLE IV

Example III was repeated using a plating bath containing 92.5 gms./l of $CuSO_4 \cdot 5H_2O$ and 343 gms./l. $H_2SO_4$. During the dendrite formation, 95 amps were applied for about 20 seconds and then reduced in the range of 90 to 60 amps for an additional 20 seconds. The tube was removed to the electroplating composition bath of Example II and plated for an additional hour at 5 amps. The tube showed fairly good hole development but no discernible nodules. The holes were very small in diameter (about 2.2 mils) and uniform in size.

EXAMPLE V

Example III was repeated using an electrolytic bath composition containing 210 gms./l. 1 of $CuSO_4 \cdot 5H_2O$ and 25 gms./l. $H_2SO_4$. Current at 95–100 amps was applied for a period of about 45 seconds and then reduced in the ranges from 95–75 amps for 15 seconds. Although the dendrite development was good, and fairly uniform plating occurred, it was noted that the dendrites were relatively weak.

EXAMPLE VI

Example III was repeated using an electrolytic bath composition containing 210 gms./l of $CuSO_4$ and 75 gms./l. $H_2SO_4$. This tube was plated for 40 seconds at 95–100 amps and an additional 20 seconds in the range from 95 to 30 amps. It was plated for one hour in the acid copper bath composition of Example II at 5 amps for build-up plating. This tube contained a good combination of holes and dendrites which were somewhat better developed at the ends than in the middle.

EXAMPLE VII

Example III was repeated using a bath containing 120 gms./l. $Cu_2SO_4 \cdot 5H_2O$ and 75 gms./l. $H_2SO_4$. The dendrite forming stage, sometimes referred to herein as "nucleation", was conducted at 100 amps for one minute and then the tubes were plated as in Example II. Holes were the predominant characteristic being uniformly spaced and quite small. The plating was evenly distributed over the tube.

EXAMPLE VIII

In order to establish the feasibility of forming dendrites by plating with other metals and metal alloys, a number of tubes were coated in a manner similar to the previous examples, but using different electrolyte compositions.

A 6 inches tube of the same type described in Example I was cleaned and etched in 50% $HNO_3$ for 15 seconds at room temperature. It was then mounted in the plating device of Example I with a 2 inches iron pipe surrounding the tube and functioning as the anode. The plating tank was filled with a ferrous electrolyte prepared as follows: 35 gms. $Fe_2O_3$ in 300 gms. NaOH, diluted to 500 ml. with water, was gently boiled for 3 hours. The excess $Fe_2O_3$ was filtered, leaving a syrupy composition. The tube was subjected to high current density — 50 amps at 75° C — and then plated at 5 amps for 45 minutes at 75° C. A very fine, weakly adherent iron powder was plated onto the tube. A more dilute bath, protected from air oxidation, would be more likely to increase the adhesion.

EXAMPLE IX

Example VIII was repeated using a 2 inches nickel pipe as the anode and a nickel electrolyte containing 40 gms./l. $NiSO_4 \cdot (NH_4)_2SO_4$ and 10 gms./l. NaCl(pH 4-4.5–30° C). Current was applied at a level of 20 amps for 15 seconds and plating conducted at 3 amps for 45 minutes. Relatively fine nickel nodules were produced but were weakly adherent.

EXAMPLE X

The tube resulting from Example IX was activated for 1 minutes in 10% HCl (30°) and then replated to build up the strength of the nodules. The electrolyte contained 240 gms./l. $NiCl_2 \cdot 6H_2O$ and 30 gms./l. boric acid (pH-1.0). It was plated at 3 amps for 1 hour and the result was an adherent, abrasion resistant coating having excellent dendrite formation.

EXAMPLE XI

Example VIII was repeated using a tubular zinc anode and a zinc electrolyte containing 180 gms./l. $ZnSO_4 \cdot 7H_2O$ and 45 gms./l. sodium acetate (pH-6). The plating sequence was: 15 seconds at 60 amps; 30 minutes at 5 amps; one hour at 3 amps. The tube displayed uniform, bright and dense zinc dendrites but the adhesion was poor.

EXAMPLE XII

Example XI was repeated using alternate nucleation and plating cycles. Five cycles were completed each using 50 amps for 2–3 seconds to nucleate and 3 amps for 10 minutes to plate. The tube was covered with strongly adherent zinc dendrites.

EXAMPLE XIII

Example XII was repeated, but 40 gms./l. of glucose was added to the zinc electrolyte. Strong, dense, zinc dendrites formed on the lower half of the tube, somewhat weaker dendrites on the top half. This deposit appeared very similar to the copper dendrite deposits of Example I which yielded good heat transfer.

EXAMPLE XIV

It has also been established that tubes formed with a dendritic coating of one metal can be plated with another different metal to provide effective heat transfer surfaces. A ¾ inch copper tube prepared in accordance with Example II was subjected to a nickel plating sequence. After etching in 50% $HNO_3$ for 10 seconds, a tube was rinsed and plated in a solution containing 240 gms./l. $NiCl_2 \cdot 6H_2O$ and 30 gms./l. boric acid. It was plated for 30 minutes at 3 amps using a nickel tube anode. The nickel plating completely covered the dendrites and was bright and metallic on smooth surfaces, grey on dendrite surfaces. The nickel plated dendrite coatings were strongly adherent to the copper tubes, tending to bridge and strengthen the surface of copper dendrites which were rolled into mechanical contact.

As noted in Example I, some advantages are gained by compacting the nodules after the tube has been plated. Compaction of the nodules may be carried out by a variety of means, for example, by hammering, by ball or shot peening, by rolling between large rollers, by rolling with a small flat roller or barrel shaped roller moved along the turning tube by a lath-like tool. The compaction tool could be loaded with a spring or weights to apply the same force to the dendrites and follow irregularities in the dendrite tube surface or it could be fixed to compact the tube to a set diameter, regardless of size variations in the dendrites and tubes. The compacting may be done by a tool which slides over the surface rather than rolls.

The surface provided by the present invention is characterized by macroscopic promontories in an irregular array over the surface of the substrate. These promontories or nodules are integrally connected to the copper grains of the substrate. The hills and valleys on the surface, especially as exaggerated by mechanical deformation of the promontory tips, appears to provide re-entrant cavities of the type which are known to result in active nucleation sites.

It is apparent that the present invention may be employed with various types of boiling liquids and different types of heat exchangers, such as, for example, tube and shell, direct expansion, and plate-type constructions.

While this invention has been described in connection with a certain specific embodiment thereof, it is to be understood that this is by way of illustration and not by way of limitation; and the scope of the appended claims should be construed as broadly as the prior art will permit.

What is claimed is:

1. A process for transferring heat from a warm fluid to a boiling liquid comprising the steps of: providing heat exchange apparatus having a thermally conductive wall, said wall having a nodularized metallic coating plated on one side thereof, said coating being characterized by a surface having macroscopic promontories extending generally normal to the surface of said wall, said promontories being irregularly arrayed, the terminal portions of said promontories being deformed laterally in a plane parallel to said coating; completely covering said coating with said liquid; and contacting the other side of said wall with said warm fluid whereby said coating enhances the formation and discharge of vapor as bubbles emerging over the surface covered by said coating.

2. The process of claim 2 wherein said coating is further characterized by a thin metallic encapulation of said promontories.

* * * * *